US012668287B2

(12) United States Patent
S et al.

(10) Patent No.: US 12,668,287 B2
(45) Date of Patent: Jun. 30, 2026

(54) SYSTEM AND METHOD FOR CONTROLLING LOCOMOTIVE

(71) Applicant: Caterpillar Inc., Peoria, IL (US)

(72) Inventors: Arshad Ahamed S, Tiruvannamalai (IN); Karthik Palanisamy, Thanjavur (IN); Kapil Jagdish Gadgil, Plainfield, IL (US)

(73) Assignee: Caterpillar Inc., Peoria, IL (US)

( * ) Notice: Subject to any disclaimer, the term of this patent is extended or adjusted under 35 U.S.C. 154(b) by 160 days.

(21) Appl. No.: 18/423,600

(22) Filed: Jan. 26, 2024

(65) Prior Publication Data

US 2025/0242842 A1 Jul. 31, 2025

(51) Int. Cl.
*B61L 15/00* (2006.01)

(52) U.S. Cl.
CPC ..... *B61L 15/0062* (2024.01); *B61L 15/0072* (2013.01); *B61L 15/009* (2013.01)

(58) Field of Classification Search
CPC .. B61L 15/006; B61L 15/0072; B61L 15/009; B61L 27/20
See application file for complete search history.

(56) References Cited

U.S. PATENT DOCUMENTS 6,024,419 A 2/2000 Waldrop et al.
2006/0253234 A1 11/2006 Kane et al.
2013/0079959 A1* 3/2013 Swanson ..... B61C 17/12 701/19
2017/0234711 A1* 8/2017 Seaton ..... F02D 29/06 73/114.52
2019/0297127 A1* 9/2019 Jovenall ..... B61L 3/125
(Continued)

FOREIGN PATENT DOCUMENTS

CN 106428126 9/2018
CN 107867269 11/2019
(Continued)

OTHER PUBLICATIONS

Railwaysignalling.Eu: The ERTMS/ETCS signalling system1 Aug. 2014, XP055367310, Retrieved from the Internet: URL:http://www.railwaysignalling.eu/wp-con tent/uploads/2014/08/ERTMS_ETCS_signalling _system_revF.pdf.
(Continued)

*Primary Examiner* — John Kwon

(57) ABSTRACT

A system for controlling a locomotive includes a display device and a controller. The display device is configured to receive a braking information to halt the locomotive from a back-office and display a notification regarding the braking information. The controller is configured to receive the braking information from the back-office to halt the locomotive, determine if a pilot present in the locomotive has any one of responded to the notification displayed on the display device within a predetermined time duration and accepted transmission of an intended braking command, by the controller, to a braking system of the locomotive to halt the locomotive, and transmit a braking command to the braking system of the locomotive to halt the locomotive if the pilot has any one of not responded to the notification within the predetermined time duration and accepted transmission of the intended braking command to the braking system.

20 Claims, 6 Drawing Sheets

(56) References Cited

U.S. PATENT DOCUMENTS

| | | | | |
|---|---|---|---|---|
| 2022/0398924 | A1* | 12/2022 | Lucas | B60W 30/0953 |
| 2023/0007902 | A1 | 1/2023 | Muthusami et al. | |
| 2023/0211817 | A1* | 7/2023 | Tripathy | B61L 27/20 246/182 R |
| 2023/0339526 | A1* | 10/2023 | Kernwein | B61L 29/24 |
| 2023/0373457 | A1* | 11/2023 | Snyder | B60T 17/221 |
| 2024/0088418 | A1* | 3/2024 | Lavertu | B60L 58/40 |
| 2024/0199101 | A1* | 6/2024 | Wait | B61C 17/12 |

FOREIGN PATENT DOCUMENTS

| | | |
|---|---|---|
| CN | 113970921 | 1/2022 |
| CN | 114572279 | 6/2022 |
| CN | 113353042 | 7/2022 |

OTHER PUBLICATIONS

Written Opinion and International Search Report for Int'l. Patent Appln. No. PCT/US2025/010166, mailed Apr. 8, 2025 (16 pgs).

* cited by examiner

SYSTEM AND METHOD FOR CONTROLLING LOCOMOTIVE

TECHNICAL FIELD

The present disclosure relates to a system for controlling a locomotive, a method for controlling the locomotive, and a site controller for the locomotive.

BACKGROUND

A consist, such as a freight train or a passenger train, generally includes a locomotive to provide motive power to railcars or carriages. In some cases, the locomotive may have to be stopped as soon as possible due to unforeseen or imminently adverse situations, for example, presence of obstacles on a route, incorrect or faulty signaling, signal failure, track wreckage, or pilot inactiveness.

Conventionally, a monitoring team located at a remote location, such as a back office, sends an alert to a pilot of the locomotive via radio regarding the unforeseen or imminently adverse situations. However, alerting the pilot using radio signals may be time consuming as the monitoring team may have to tune in to the designated radio frequency and connect with the pilot of the locomotive. In some situations, the pilot may need additional time to respond that may cause further delays in stopping of the locomotive. In some cases, the pilot may be unresponsive, for example, due to a personal break or if the pilot is experiencing an adverse medical condition. In such situations, the pilot may be unable to attend to commands issued via radio. Any delays in halting the locomotive may increase risk to both life and property.

Further, if multiple locomotives are operating on a route or in a predefined area, then the pilots of all such locomotives can only be informed in a sequential manner, for example, based on a location of each locomotive or which locomotive needs to be stopped first. However, such an approach may lead to undesirable delays and latency.

Chinese Publication 114572279, hereinafter referred to as '279 reference, describes an intelligent protection system for rail transit remote driving, and belongs to the technical field of urban rail train remote and active obstacle detection. The invention uses edge computing system (ECS) to complete obstacle recognition at the vehicle end, and uploads results to a centralized control system (CCS) after the recognition result is combined with the video stream, thereby saving bandwidth resources. Because the identification process is finished at the ECS end by using the original video, the compression processing in the wireless communication process is avoided, and the identification performance can be effectively improved; the ECS intelligent protection mode establishing process combines the train-ground function and the manual confirmation step, can ensure that the ECS safely obtains driving permission, and the train state is necessarily in a stable stopping and emergency braking safety state when the process is finished no matter whether the driving permission is obtained or not; the safety protection of the rail transit remote driving intelligent protection System (R.R.D.I.P.) system is calculated and output by the ECS at the train end in real time, so that the real-time property of outputting the emergency brake is ensured, and the condition that the emergency brake is not output timely due to wireless delay and the danger is caused by remote driving is avoided.

Thus, the system described in the '279 reference focusses on obstacle recognition in a path of the train and causes application of the emergency brake of the train when obstacles are present in the path of the train. However, the system described in the '279 reference does not consider other factors, such as, incorrect or faulty signaling, signal failure, track wreckage, or pilot inactiveness that may require immediate stopping of the train. Moreover, the system described in the '279 reference does not describe emergency braking of multiple locomotives operating on the same path or within a predefined area.

SUMMARY

In an aspect, a system for controlling a locomotive is provided. The system includes a display device disposed in the locomotive. The display device is configured to receive a braking information to halt the locomotive from a back-office. The display device is also configured to display a notification regarding the braking information thereon. The system also includes a controller disposed in the locomotive and in communication with the display device. The controller is configured to receive the braking information from the back-office to halt the locomotive. The controller is also configured to determine if a pilot present in the locomotive has any one of responded to the notification displayed on the display device within a predetermined time duration and accepted transmission of an intended braking command, by the controller, to a braking system of the locomotive to halt the locomotive. The controller is further configured to transmit a braking command to the braking system of the locomotive to halt the locomotive if the pilot has any one of not responded to the notification within the predetermined time duration and accepted transmission of the intended braking command to the braking system.

In another aspect, a method for controlling a locomotive is provided. The method includes receiving, by a display device disposed in the locomotive, a notification regarding a braking information to halt the locomotive from a back-office. The method also includes displaying the notification on the display device. The method further includes receiving, by a controller disposed in the locomotive and in communication with the display device, the braking information from the back-office to halt the locomotive. The method includes determining, by the controller, if a pilot present in the locomotive has any one of responded to the notification displayed on the display device within a predetermined time duration and accepted transmission of an intended braking command, by the controller, to a braking system of the locomotive to halt the locomotive. The method also includes transmitting, by the controller, a braking command to the braking system of the locomotive to halt the locomotive if the pilot has any one of not responded to the notification within the predetermined time duration and accepted transmission of the intended braking command to the braking system.

In yet another aspect, a site controller for a locomotive is provided. The site controller is configured to receive a braking information from a back-office to halt the locomotive. The site controller is also configured to determine if a pilot present in the locomotive has any one of responded to a notification, displayed on a display device in communication with the site controller, regarding the braking information to halt the locomotive within a predetermined time duration and accepted transmission of an intended braking command, by the controller, to a braking system of the locomotive to halt the locomotive. The display device is configured to receive the braking information from the back-office. The site controller is further configured to transmit a braking command to the braking system of the locomotive to halt the locomotive if the pilot has any one of not responded to the notification within the predetermined time duration and accepted transmission of the intended braking command to the braking system.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
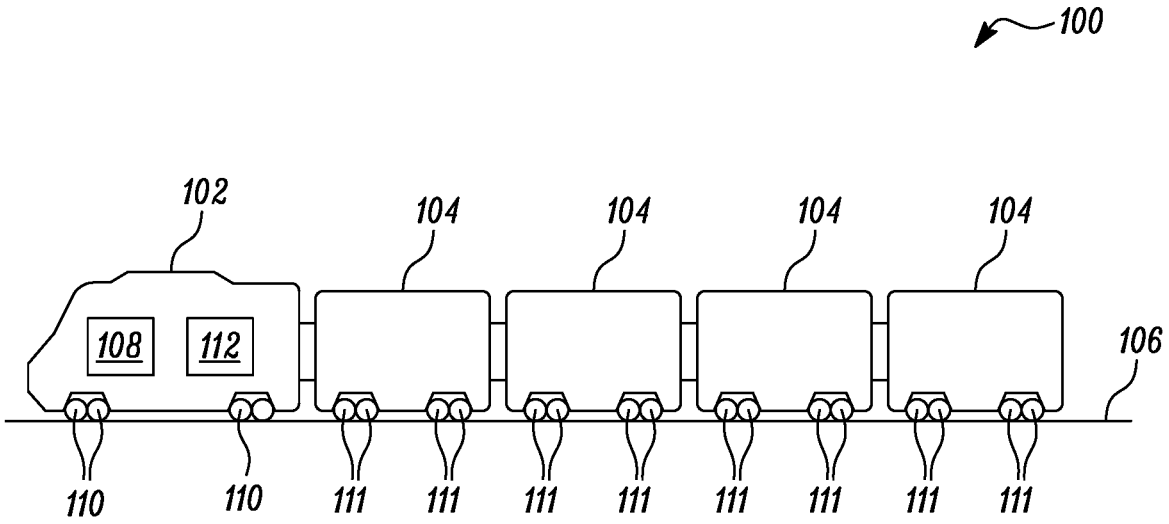
FIG. 1 is a diagrammatic side view of an exemplary locomotive.

Referring to FIG. 1, a diagrammatic side view of an exemplary rail transport vehicle 100 is illustrated. The rail transport vehicle 100 may be replaced by any type of vehicle or machine used to perform driven operation involving physical movement associated with any industry, such as, transportation, mining, construction, landscaping, forestry, agriculture, and so on. Non-limiting examples of vehicles, for both commercial and industrial purposes, include trains, diesel-electric locomotives, diesel mechanical locomotives, and other types that operate in a work environment. It is to be understood that the rail transport vehicle 100 is shown primarily for illustrative purposes to assist in disclosing features of the disclosure, and that FIG. 1 does not depict all of the components of the rail transport vehicle 100.

The rail transport vehicle 100 includes a locomotive 102 coupled to one or more railcars 104. The rail transport vehicle 100 may travel along a route 106, such as, one or more rails of a track. The railcars 104 may be passenger cars and/or freight cars for carrying passengers, goods, or other loads. The locomotive 102 includes a power source 108. The power source may be an engine, a battery system, a fuel cell, and so on. The engine may be diesel, steam, hydrogen, gas turbine powered, hybrid, or of any other type for generating energy to propel the rail transport vehicle 100. Further, the locomotive 102 includes a number of wheels 110 and each railcar 104 also includes a number of wheels 111. The locomotive 102 further includes a braking system 112 to halt the locomotive 102, as and when desired. The braking system 112 is operatively connected to the wheels 110 of the locomotive 102 for halting the locomotive 102.

Figure 2:
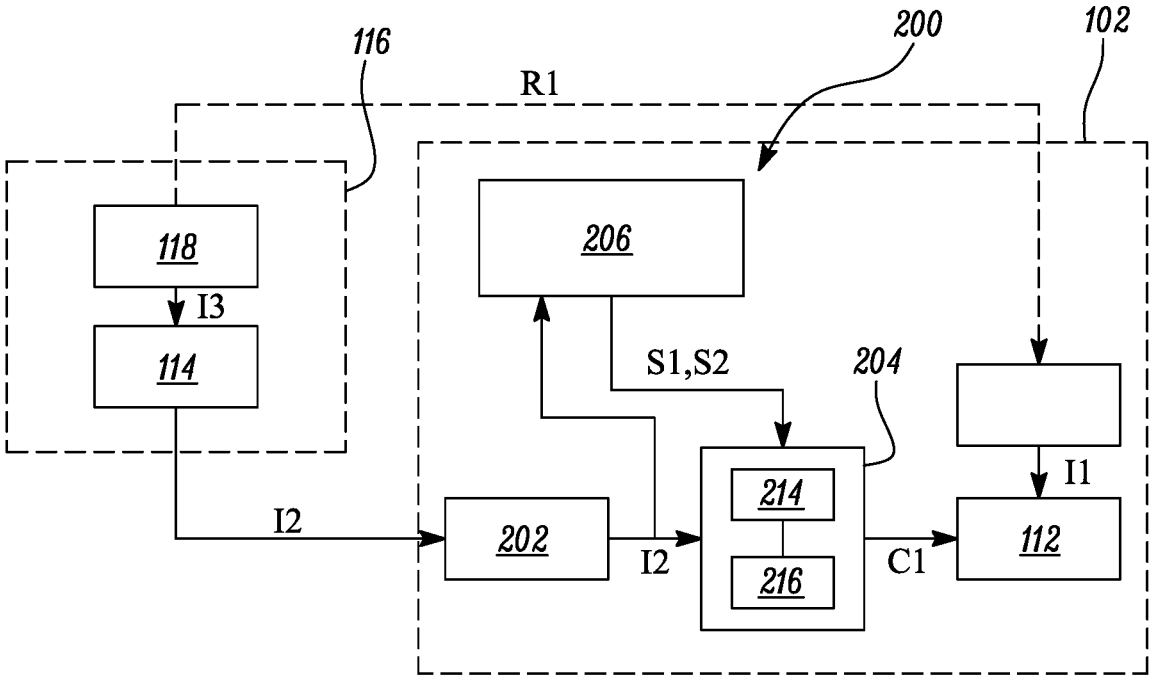
FIG. 2 is a block diagram of a system for controlling the locomotive of FIG. 1, according to an embodiment of the present disclosure.

Referring now to FIG. 2, the present disclosure relates to a system 200 for controlling the locomotive 102 of FIG. 1. Although only one locomotive 102 is illustrated in FIG. 1, the system 200 may be used to control any number of locomotives 120, 122 (shown in FIG. 4) that may operate on the route 106 (see FIG. 1) or within a predetermined virtual boundary V1 (shown in FIG. 4).

FIG. 2 also illustrates a back-office controller 114. The back-office controller 114 may be present at a back-office 116 or any other remote location. The back-office controller 114 may receive real-time information/parameters associated with the route 106 (see FIG. 1), the locomotive 102, signals on the route 106, track wreckage, objects/obstructions on the route 106, and so on. Further, one or more back-office personnel 118 are present at the back-office 116. The back-office personnel 118 may be in-charge of monitoring the route 106 or the predetermined virtual boundary V1 and may be informed about different situations prevailing on the route 106 or within the predetermined virtual boundary V1. For example, the back-office personnel 118 may be apprised about an impending situation that may require immediate braking/halting of the locomotive 102 operating on the route 106.

Further, when the back-office personnel 118 determines that the situation may require immediate halting of the locomotive 102, the back-office personnel 118 tries to establish contact with a pilot 124 of the locomotive 102 via radio communication R1. If the radio communication R1 is established, and if the pilot 124 responds to the radio call, the back-office personnel 118 may alert the pilot 124 regarding the situation requiring immediate stoppage and may further instruct them to stop the locomotive 102. Further, based on the information received from the back-office personnel 118, the pilot 124 transmits a manual input I1 to the braking system 112 of the locomotive 102 to halt the locomotive 102.

However, in some situations, the radio communication R1 may not be established or the pilot 124 may not respond to the radio call. In such situations, the system 200 may be used to halt the locomotive 102 in a manner that will now be described in detail.

The system 200 includes a communication device 202 in communication with a controller 204 and a display device 206. The back-office controller 114 is in communication with the communication device 202. The communication device 202 receives a braking information I2 from the back-office 116 to halt the locomotive 102. Specifically, the back-office controller 114 generates the braking information I2 based on an input I3 received from the back-office personnel 118 present at the back-office 116. Further, the back-office controller 114 transmits the braking information I2 to the communication device 202.

The system 200 also includes the display device 206 disposed in the locomotive 102. The display device 206 may present various information regarding the locomotive 102 to the pilot 124 of the locomotive 102. The display device 206 may include any input/output device that may allow the pilot 124 to provide inputs to the locomotive 102, for example, to control the locomotive 102. The display device 206 may include a human machine interface. The display device 206 may include a tablet, a laptop, a portable input/output module, and so on. Further, the display device 206 may provide various details, such as, the current speed of the locomotive 102, a distance covered from a location, an impending distance to a target location, a navigation aid, and so on. Furthermore, the display device 206 may present various alerts or notifications thereon.

The display device 206 receives the braking information I2 to halt the locomotive 102 from the back-office 116. Specifically, the communication device 202 transmits the braking information I2 to the display device 206. Further, the display device 206 displays a notification N1 (shown in FIG. 3) regarding the braking information I2 thereon. It should be noted that the display device 206 may have a processor/controller embedded therein that receives and processes the braking information I1 to generate the notification N1. Further, the notification N1 may include a text message, an audio message, a buzzer, an alarm, and/or combinations thereof. Details of an exemplary notification N1 that may be displayed on the display device 206 will be described in detail later in this section with reference to FIG. 3.

The system 200 further includes the controller 204. The controller 204 may include a site controller. The controller 204 will hereinafter be referred to as "the site controller" and denoted using identical reference numeral "204". The controller 204 is disposed in the locomotive 102 and in communication with the display device 206. The controller 204 may include one or more memories 214 and one or more processors 216 in communication with the one or more memories 214. The one or more memories 214 may include any means of storing information, including a hard disk, an optical disk, a floppy disk, ROM (read only memory), RAM (random access memory), PROM (programmable ROM), EEPROM (electrically erasable PROM), and/or other computer-readable memory media. For example, the memories 214 may store data, such as, software applications, algorithms, instructions, and arithmetic operations.

The processors 216 may execute various types of digitally stored instructions, such as, software applications or algorithms, retrieved from the memories 214, or a firmware program which may enable the processors 216 to perform a wide variety of operations. It should be noted that the processors 216 may embody a single microprocessor or multiple microprocessors for receiving various input signals and generating output signals. Numerous commercially available microprocessors may perform the functions of the processors 216. Each processor 216 may further include a general processor, a central processing unit, an application specific integrated circuit (ASIC), a digital signal processor, a field programmable gate array (FPGA), a digital circuit, an analog circuit, a microcontroller, any other type of processor, or any combination thereof. Each processor 216 may include one or more components that may be operable to execute computer executable instructions or computer code that may be stored and retrieved from the memories 214.

The controller 204 receives the braking information I2 from the back-office 116 to halt the locomotive 102. Specifically, based on a requirement of immediate halting of the locomotive 102, the back-office controller 114 transmits the braking information I2 to the communication device 202. Further, the communication device 202 transmits the braking information I2 to the controller 204.

The controller 204 further determines if the pilot 124 present in the locomotive 102 has responded to the notification N1 displayed on the display device 206 within a predetermined time duration or accepted transmission of an intended braking command by the controller 204 to the braking system 112 of the locomotive 102 to halt the locomotive 102. The predetermined time duration may be stored within the memories 214 of the controller 204. In some examples, the predetermined time duration may be approximately 10 seconds, for example.

Further, the controller 204 transmits a braking command C1 to the braking system 112 of the locomotive 102 to halt the locomotive 102 if the pilot 124 has not responded to the notification N1 within the predetermined time duration or accepted transmission of the intended braking command to the braking system 112.

Specifically, in a first scenario, the controller 204 may wait until the elapse of the predetermined time duration to determine if the pilot 124 has accepted or rejected the transmission of the intended braking command to the braking system 112. If the controller 204 determines that the pilot 124 has not responded to the notification N1, the controller 204 may determine that the pilot 124 is unavailable to take any action in response to the notification N1. In such a situation, the controller 204 transmits the braking command C1 to the braking system 112 of the locomotive 102 to halt the locomotive 102.

Further, in a second scenario, in which the pilot 124 responds to the notification N1, the controller 204 may receive a first signal S1 from the display device 206 confirming that the pilot 124 has accepted the transmission of the intended braking command. Specifically, referring to FIG. 3, the notification N1 includes a prompt window 208 displayed on the display device 206. The prompt window 208 allows the pilot 124 (see FIG. 2) to accept the intended braking command to the braking system 112 (see FIG. 2) of the locomotive 102 (see FIGS. 1 and 2) or reject the intended braking command to the braking system 112 of the locomotive 102.

The prompt window 208 may include an icon 210 with the text "ACCEPT". Alternatively, the icon 210 may include any other text or symbols. Pressing the icon 210 by the pilot 124 may lead to the acceptance of the intended braking command and the first signal S1 (see FIG. 2) will be sent to the controller 204 (see FIG. 2). In such a situation, if the controller 204 receives the first signal S1 regarding the acceptance of the intended braking command, the controller 204 transmits the braking command C1 to the braking system 112 of the locomotive 102 to halt the locomotive 102.

Further, the prompt window 208 may include an icon 212 with the text "REJECT". Alternatively, the icon 212 may include any other text or symbols. Pressing the icon 212 by the pilot 124 may lead to the rejection of the intended braking command and a second signal S2 (see FIG. 2) will be sent to the controller 204. Thus, the second signal S2 from the display device 206 indicates that the pilot 124 has rejected the transmission of the intended braking command by the controller 204. If the controller 204 receives the second signal S2, the controller 204 does not take any further action. Further, the pilot 124 transmits the manual input I1 (see FIG. 2) to the braking system 112 of the locomotive 102 based on the rejection of the intended braking command to the braking system 112 of the locomotive 102. In other words, the pilot 124 may reject the transmission of the intended braking command by the controller 204 and may themself transmit the manual input I1 to the braking system 112.

Referring again to FIG. 2, the controller 204 computes a maximum allowable braking pressure for the braking system 112 of the locomotive 102. For this purpose, the controller 204 determines the current speed of the locomotive 102. The controller 204 may be in communication with one or more sensors (not shown) onboard the locomotive 102 that may generate a speed signal indicating the current speed of the locomotive 102. Further, the controller 204 computes the maximum allowable braking pressure for the braking system 112 of the locomotive 102 based on analysis of the current speed of the locomotive 102 and a speed-to-brake ratio for the locomotive 102. The speed-to-brake ratio may be predetermined and stored within the memories 214 of the controller 204. Furthermore, the controller 204 transmits the braking command C1 based on the computed maximum allowable braking pressure.

It should be noted that, in some examples, wherein the display device 206 does not have a processor/controller of its own, the controller 204 may generate and transmit the notification N1 to the display device 206. The display device 206 may then display the notification N1 thereon.

Figure 4:
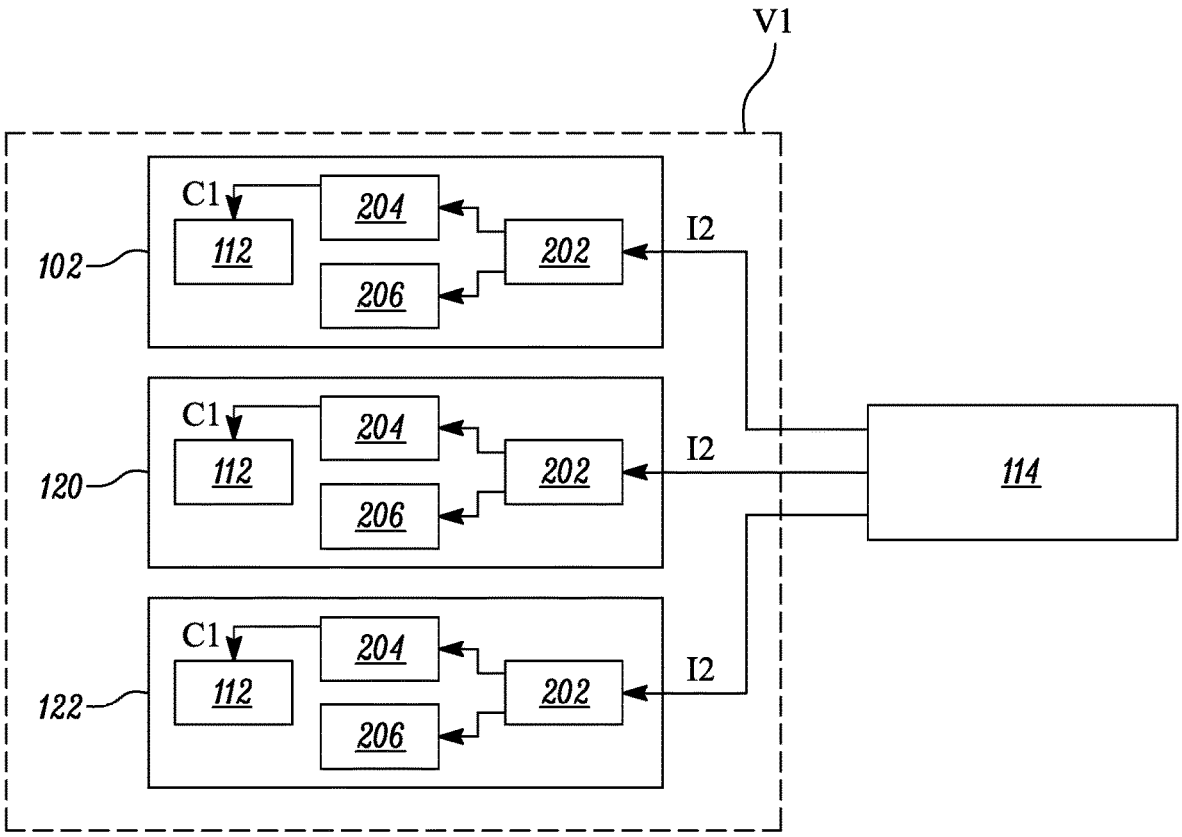
FIG. 4 is a block diagram illustrating a group of locomotives operating within a predetermined virtual boundary.

Referring now to FIG. 4, the locomotive 102 is from a group of the number of locomotives 102, 120, 122 operating within the predetermined virtual boundary V1. Further, each of the number of locomotives 102, 120, 122 includes a corresponding display device 206, a corresponding controller 204, and a corresponding communication device 202. It should be noted that the communication device 202 of each locomotive 102 may receive the braking information I2 from the back-office controller 114 at the same time. Further, based on the response received from the pilots, the controller 204 may transmit the braking command C1 to the braking system 112 of the corresponding locomotives 102, 120, 122.

Figure 5:
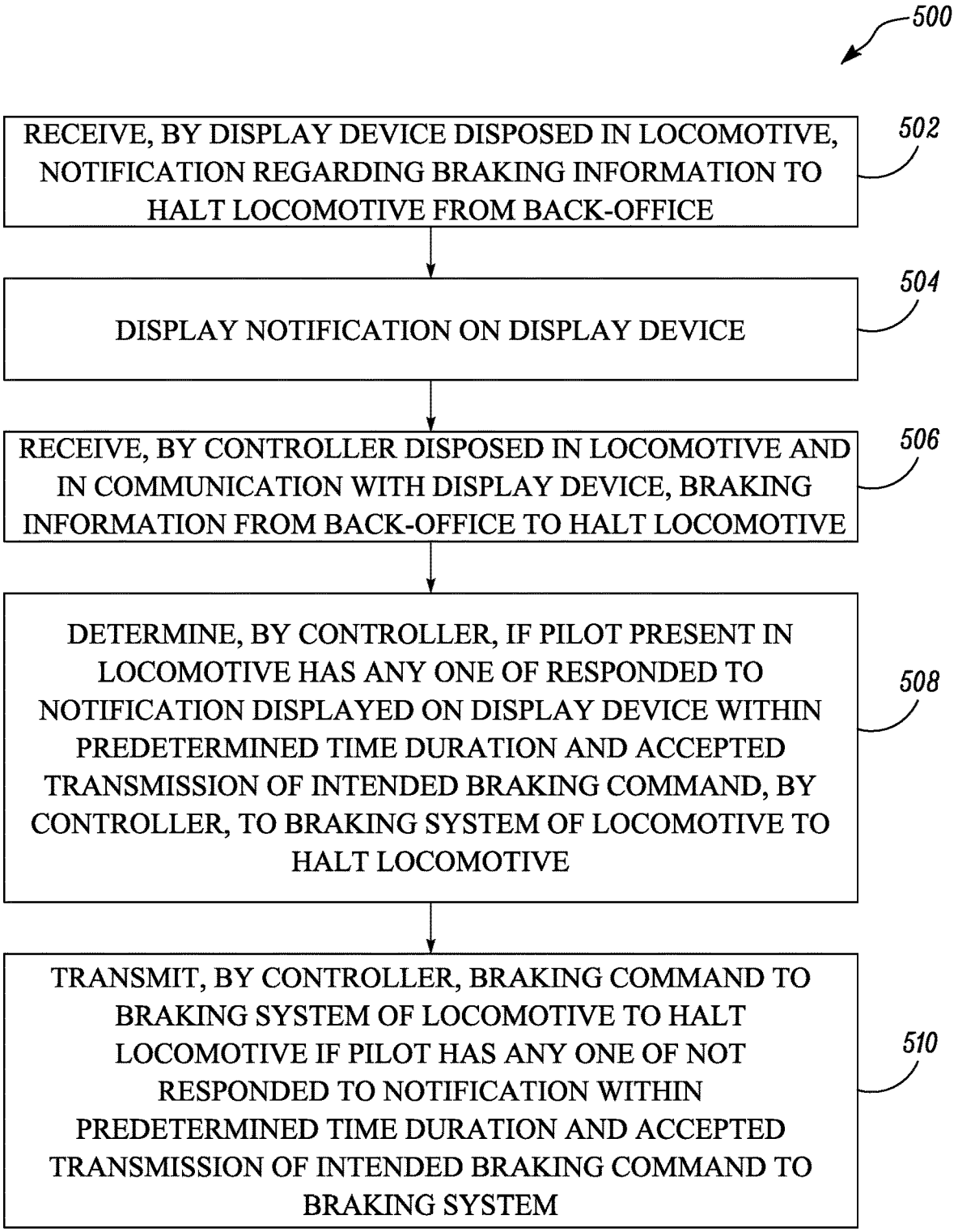
FIG. 5 is a flowchart of a method for controlling the locomotive, according to an embodiment of the present disclosure.

FIG. 5 is a flowchart of a method 500 for controlling the locomotive 102. Referring to FIGS. 1 to 5, the locomotive 102 is from the group of the number of locomotives 102, 120, 122 operating within the predetermined virtual boundary V1. Each of the number of locomotives 102, 120, 122 includes the corresponding display device 206, the corresponding controller 204, and the corresponding communication device 202.

At step 502, the display device 206 disposed in the locomotive 102 receives the notification N1 regarding the braking information I2 to halt the locomotive 102 from the back-office 116. At step 504, the notification N1 is displayed on the display device 206.

At step 506, the controller 204 disposed in the locomotive 102 and in communication with the display device 206 receives the braking information I2 from the back-office 116 to halt the locomotive 102. At step 508, the controller 204 determines if the pilot 124 present in the locomotive 102 has responded to the notification N1 displayed on the display device 206 within the predetermined time duration or accepted transmission of the intended braking command, by the controller 204, to the braking system 112 of the locomotive 102 to halt the locomotive 102.

At step 510, the controller 204 transmits the braking command C1 to the braking system 112 of the locomotive 102 to halt the locomotive 102 if the pilot 124 has not responded to the notification N1 within the predetermined time duration or accepted transmission of the intended braking command to the braking system 112.

The method 500 also includes a step at which the communication device 202 in communication with the controller 204 and the display device 206 receives the braking information I2 from the back-office 116 to halt the locomotive 102. The method 500 further includes a step at which the communication device 202 transmits the braking information I2 to the controller 204. The method 500 further includes a step at which the communication device 202 transmits the braking information I2 to the display device 206.

The method 500 also includes a step at which the back-office controller 114 generates the braking information I1 based on the input I3 from the back-office personnel 118 present at the back-office 116. The back-office controller 114 is in communication with the communication device 202. The method 500 also includes a step at which the back-office controller 114 transmits the braking information I2 to the communication device 202.

Further, the notification N1 includes the prompt window 208 displayed on the display device 206. The method 500 further includes a step at which the pilot 124 accepts the intended braking command to the braking system 112 of the locomotive 102 via the prompt window 208 or rejects the intended braking command to the braking system 112 of the locomotive 102 via the prompt window 208. Furthermore, the method 500 includes a step at which the pilot 124 transmits the manual input I1 to the braking system 112 of the locomotive 102 based on rejection of the intended braking command to the braking system 112 of the locomotive 102.

The method 500 includes a step at which the controller 204 determines the current speed of the locomotive 102. The method 500 also includes a step at which the controller 204 computes the maximum allowable braking pressure for the braking system 112 of the locomotive 102, based on analysis of the current speed of the locomotive 102 and the speed-to-brake ratio for the locomotive 102. The method 500 further includes a step at which the controller 204 transmits the braking command C1 based on the computed maximum allowable braking pressure.

It may be desirable to perform one or more of the steps shown in FIG. 5 in an order different from that depicted. Furthermore, various steps could be performed together.

Figure 3:
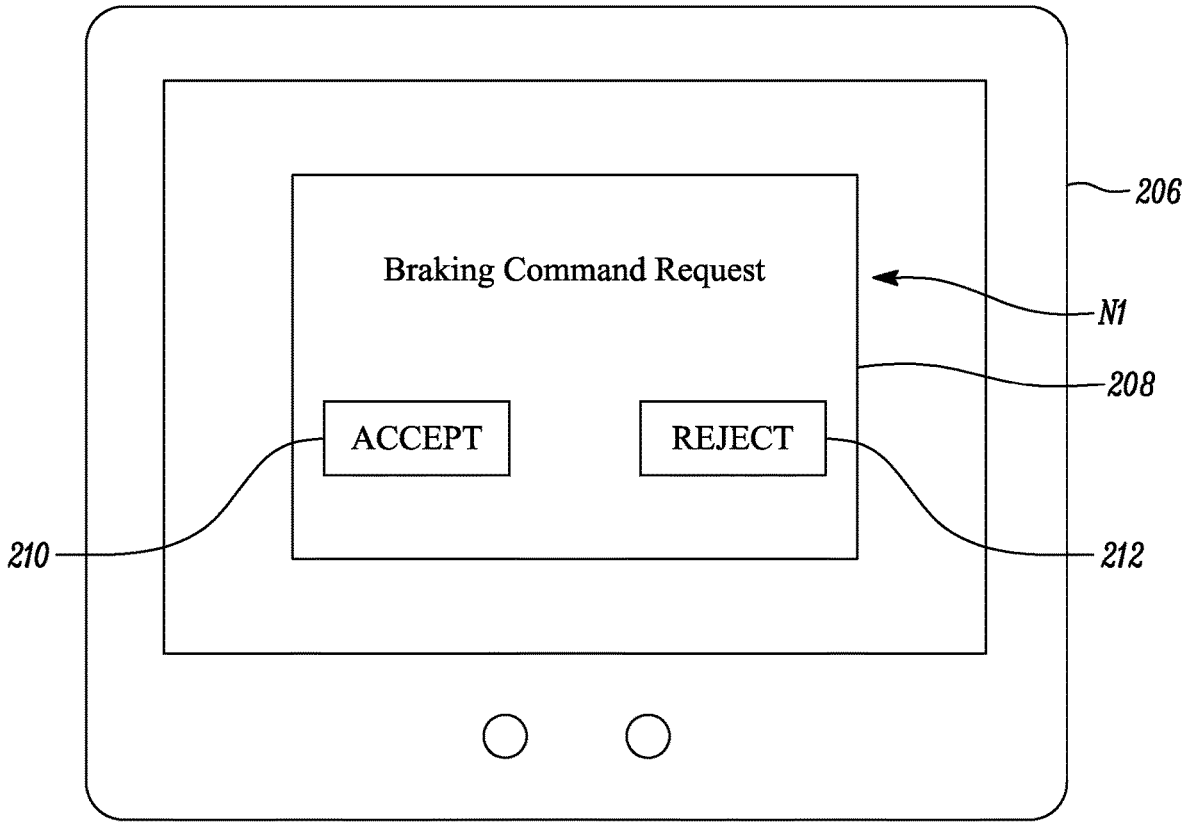
FIG. 3 is an exemplary prompt window displayed on a display device of the system of FIG. 2.
Figure 6:
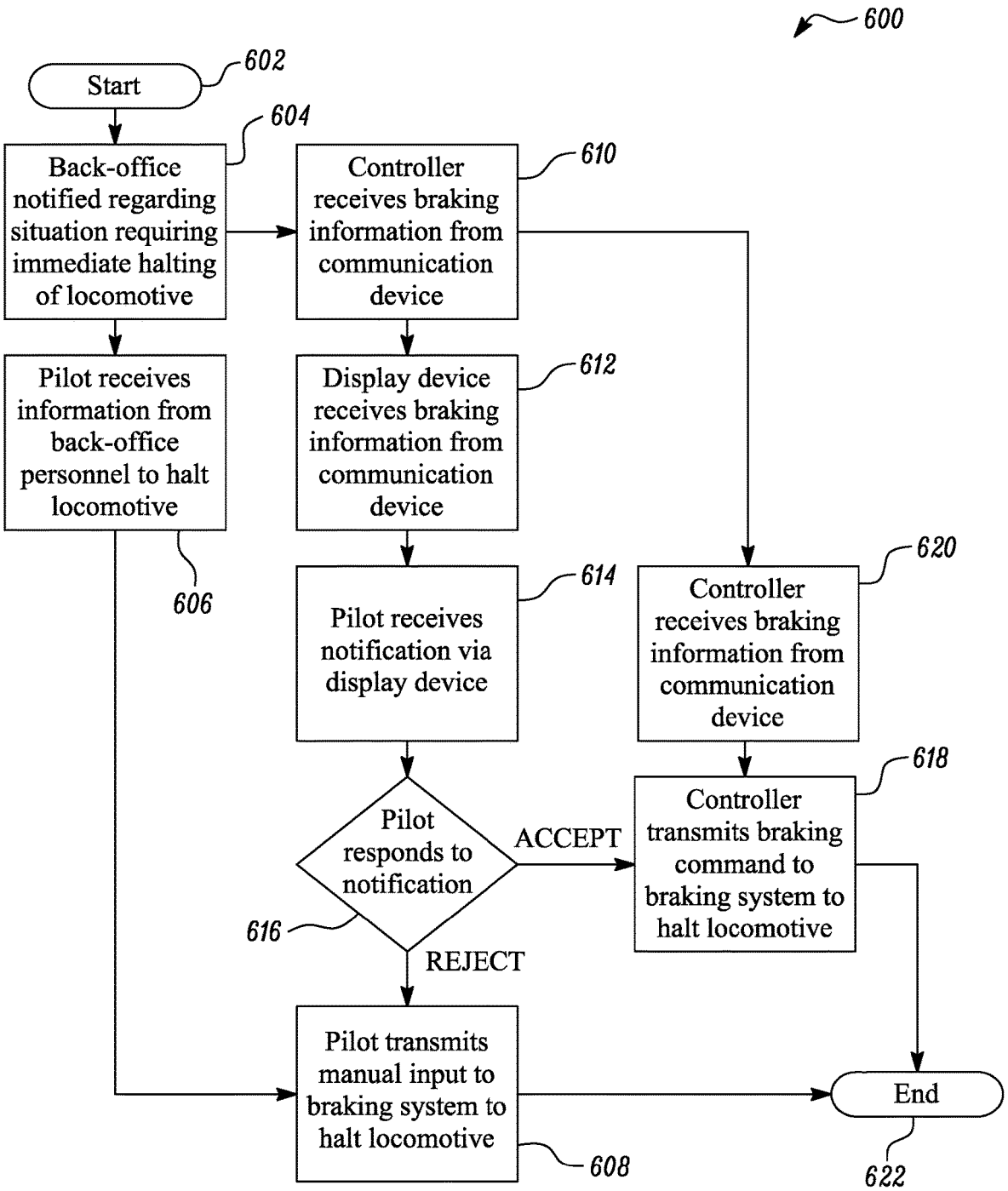
FIG. 6 is a process flowchart for low-level implementation of the method of FIG. 5, according to an embodiment of the present disclosure.

FIG. 6 illustrates a process flowchart 600 for controlling the locomotive 102. The process 600 is a low-level implementation of the method 500 explained in relation to FIG. 5. Referring to FIGS. 2, 3, and 6, the process 700 may be stored in the memories 214 of the controller 314 and retrieved for execution by the processors 216 of the controller 314.

The process 600 starts at a block 602. Further, at a block 604, the back-office 116 is notified regarding the situation which may require immediate halting of the locomotive 102. At the block 604, the back-office personnel 118 tries to notify the pilot 124 of the locomotive 102 to halt the locomotive 102 via the radio communication R1. At the block 604, the back-office personnel 118 also provides the input regarding the braking information I2 to the back-office controller 114. Further, the back-office controller 114 transmits the braking information I2 to the communication device 202.

From the block 604, the process 600 moves to a block 606, at which the pilot 124 receives the information from the back-office personnel 118. Further, at a block 608, the pilot 124 transmits the manual input I1 to the braking system 112 to halt the locomotive 102.

Moreover, from the block 604, the process 600 also moves to a block 610, at which the communication device 202 receives the braking information I2 from the back-office controller 114. The process 600 then moves to a block 612 at which the display device 206 receives the braking information I2 from the communication device 202. Based on the braking information I2, the display device 206 displays the notification N1 therein. At a block 614, the pilot 124 receives the notification N1 via the display device 206. At a block 616, the pilot 124 responds to the notification N1 by accepting or rejecting the intended braking command. If the pilot 124 rejects the intended braking command, the process 600 moves to the block 608 at which the pilot 124 transmits the manual input I1 to the braking system 112 to halt the locomotive 102.

However, if the pilot 124 accepts the intended braking command, the process 600 moves to a block 618. At the block 618, the controller 204 transmits the braking command C1 to the braking system 112 to halt the locomotive 102.

Further, from the block 610, the process 600 also moves to a block 620 at which the controller 204 receives the braking information I2 from the communication device 202. At the block 610, the controller 204 also determines if the pilot 124 has responded to the notification N1 within the predetermined time duration. If the controller 204 determines that the pilot 124 has not responded to the notification N1 within the predetermined time duration, the process 600 moves to the block 618 at which the controller 204 transmits the braking command C1 to the braking system 112 to halt the locomotive 102. However, at the block 618, if the controller 204 determines that the pilot 124 has rejected the intended braking command, the controller 204 does not take any action. Further, from the blocks 608, 618, the process 600 moves to a block 622 at which the process 600 ends.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure is directed towards the system 200 and the method 500 for controlling the locomotive 102. The system 200 and the method 500 may allow automated and simultaneous braking of the number of locomotives 102, 120, 122 in response to a situation requiring immediate halting of the locomotives 102, 120, 122. The system 200 and the method 500 described herein may be used to notify and/or halt multiple locomotives 102, 120, 122 in a single control action, for e.g., based on the single input I3 generated by the back-office personnel 118. Further, the system 200 and the method 500 may eliminate a need to establish contact with pilots of each locomotive 102, 120, 122 via radio communication R1 and wait for their response during urgencies, that is typically time consuming and may lead to latency.

Furthermore, the system 200 and the method 500 can be used to halt the locomotive 102 without any intervention by the pilots. Thus, the system 200 and the method 500 may be especially advantageous in situations wherein the pilot is unresponsive, for example, due to an adverse medical condition or a personal break. Overall, the system 200 and the method 500 describes herein may improve operational safety of the locomotive 102, by providing an option to apply brakes in absence of response from pilots. Moreover, the speed-to-brake ratio is computed for each locomotive 102, 120, 122 prior to operation of the locomotive 102, 120, 122. The speed-to-brake ratio is stored in the memories 214 of the corresponding controllers 204. Further, the braking command C1 is applied as per the maximum allowable braking pressure for the braking system 112 that is determined by the corresponding controllers 204 based on the current speed of the locomotive 102, 120, 122 and the speed-to-brake ratio, which may prevent derailing of the locomotive 102, 120, 122 and may improve operational safety of the locomotive 102, 120, 122.

While aspects of the present disclosure have been particularly shown and described with reference to the embodiments above, it will be understood by those skilled in the art that various additional embodiments may be contemplated by the modification of the disclosed machine, systems and methods without departing from the spirit and scope of the disclosure. Such embodiments should be understood to fall within the scope of the present disclosure as determined based upon the claims and any equivalents thereof.

What is claimed is:

1. A system for controlling a locomotive, the system comprising:
- a display device disposed in the locomotive, wherein the display device is configured to:
  - receive braking information, sent by a back-office controller, indicating a back-office determination that the locomotive is to halt by performing a braking operation; and
  - display a notification in response to receiving the braking information, wherein the notification:
    - indicates a request for a braking command to initiate automated performance of the braking operation based on the back-office determination; and
    - provides one or more elements configured to receive:
      - first user input, from a pilot of the locomotive, indicative of acceptance of the request for the braking command; and
      - second user input, from the pilot, indicative of rejection of the request for the braking command; and
- a controller disposed in the locomotive and in communication with the display device, wherein the controller is configured to:
  - receive the braking information sent by the back-office controller; and
  - transmit the braking command, to a braking system of the locomotive, to initiate the automated performance of the braking operation in response to:
    - a first determination that neither of the first user input or the second user input has been received via the display device within a predetermined time duration, or
    - a second determination that the first user input, indicative of the acceptance of the request for the braking command, has been received via the display device within the predetermined time duration.

2. The system of claim 1, further comprising a communication device disposed in the locomotive that is in communication with the controller and the display device, wherein the communication device is configured to:
- receive the braking information from the back-office controller; and
- transmit the braking information to the controller.

3. The system of claim 2, wherein the communication device is configured to transmit the braking information to the display device.

4. The system of claim 2, wherein:
- the back-office controller receives an input indicating the back-office determination from a back-office personnel present at a back-office, and
- the back-office controller sends the braking information to the communication device in response to the input.

5. The system of claim 2, wherein:
- the locomotive is within a group comprising a plurality of locomotives operating within a predetermined virtual boundary, and
- each of the plurality of locomotives includes a corresponding display device, a corresponding controller, and a corresponding communication device.

6. The system of claim 1, wherein the notification comprises a prompt window, displayed via the display device, that presents the one or more elements as:

a first icon configured to, based on a first selection of the first icon, provide the first user input indicative of the acceptance of the request for the braking command; and a second icon configured to, based on a second selection of the second icon, provide the second user input indicative of the rejection of the request for the braking command.

7. The system of claim 1, wherein;

the controller receives the second user input, indicative of the rejection of the request for the braking command, via the display device within the predetermined time duration, the controller is configured to refrain, in response to the second user input, from transmitting the braking command to the braking system to initiate the automated performance of the braking operation, and the pilot transmits a manual input to the braking system of the locomotive to manually initiate the braking operation.

8. The system of claim 1, wherein the controller is configured to:

determine a current speed of the locomotive;

compute a maximum allowable braking pressure for the braking system of the locomotive, based on analysis of the current speed of the locomotive and a speed-to-brake ratio for the locomotive; and transmit the braking command based on the computed maximum allowable braking pressure.

9. A method for controlling a locomotive, the method comprising:

receiving, by a display device disposed in the locomotive, braking information sent by a back-office controller, wherein the braking information indicates a back-office determination that the locomotive is to halt by performing a braking operation;

displaying, by the display device in response to receiving the braking information, a notification that:

indicates a request for a braking command to initiate automated performance of the braking operation based on the back-office determination; and provides one or more elements configured to receive:

first user input, from a pilot of the locomotive, indicative of acceptance of the request for the braking command; and second user input, from the pilot, indicative of rejection of the request for the braking command;

receiving, by a controller disposed in the locomotive and in communication with the display device, the braking information sent by the back-office controller; and transmitting, by the controller, the braking command to a braking system of the locomotive, to initiate the automated performance of the braking operation in response to:

a first determination that neither of the first user input or the second user input has been received via the display device within a predetermined time duration, or a second determination that the first user input, indicative of the acceptance of the request for the braking command, as been received via the display device within the predetermined time duration.

10. The method of claim 9, further comprising:

receiving, by a communication device disposed in the locomotive that is in communication with the controller and the display device, the braking information from the back-office controller; and transmitting, by the communication device, the braking information to the controller.

11. The method of claim 10, further comprising transmitting, by the communication device, the braking information to the display device.

12. The method of claim 10, further comprising:

receiving, by the back-office controller, an input indicating the back-office determination from a back-office personnel present at a back-office, wherein the back-office controller sends the braking information to the communication device.

13. The method of claim 9, wherein the notification comprises a prompt window, displayed via the display device, that presents the one or more elements as:

a first icon configured to, based on a first selection of the first icon, provide the first user input indicative of the acceptance of the request for the braking command; and a second icon configured to, based on a second selection of the second icon, provide the second user input indicative of the rejection of the request for the braking command.

14. The method of claim 9, further comprising:

determining, by the controller, a current speed of the locomotive;

computing, by the controller, a maximum allowable braking pressure for the braking system of the locomotive, based on analysis of the current speed of the locomotive and a speed-to-brake ratio for the locomotive; and transmitting, by the controller, the braking command based on the computed maximum allowable braking pressure.

15. The method of claim 10, wherein;

the locomotive is within a group comprising a plurality of locomotives operating within a predetermined virtual boundary, and each of the plurality of locomotives includes a corresponding display device, a corresponding controller, and a corresponding communication device.

16. A site controller, associated with a locomotive, configured to:

receive braking information, sent by a back-office controller, indicating a back-office determination that the locomotive is to halt by performing a braking operation, wherein:

a display device disposed in the locomotive and in communication with the site controller is configured to display, based on the braking information, a notification that:

indicates a request for a braking command to initiate automated performance of the braking operation based on the back-office determination; and provides one or more elements configured to receive:

first user input, from a pilot of the locomotive, indicative of acceptance of the request for the braking command; and second user input, from the pilot, indicative of rejection of the request for the braking command; and transmit the braking command to a braking system of the locomotive, to initiate the automated performance of the braking operation in response to:

a first determination that neither of the first user input or the second user input has been received via the display device within a predetermined time duration, or a second determination that the first user input, indicative of the acceptance of the request for the braking command, has been received via the display device within the predetermined time duration.

17. The site controller of claim 16, wherein the site controller is further configured to:

determine a current speed of the locomotive;

compute a maximum allowable braking pressure for the braking system of the locomotive, based on analysis of the current speed of the locomotive and a speed-to-brake ratio for the locomotive; and transmit the braking command based on the computed maximum allowable braking pressure.

18. The system of claim 4, wherein the back-office controller receives the input from the back-office personnel in response to an unsuccessful attempt, by the back-office personnel, to express the back-office determination to the pilot of the locomotive via a radio communication.

19. The system of claim 5, wherein the back-office controller sends the braking information to the corresponding communication device of each of the plurality of locomotives within the predetermined virtual boundary, to indicate the back-office determination that each of the plurality of locomotives within the predetermined virtual boundary are to halt by performing braking operations.

20. The system of claim 19, wherein the braking information causes simultaneous automated braking of the plurality of locomotives within the predetermined virtual boundary.

* * * * *